US005340039A

United States Patent [19]

Lefevre

[11] Patent Number: 5,340,039

[45] Date of Patent: Aug. 23, 1994

[54] MEDICAL WASTE DISPOSAL APPARATUS

[75] Inventor: Mark S. Lefevre, Lansing, Mich.

[73] Assignee: Lefevre Corporation, Lansing, Mich.

[21] Appl. No.: 134,279

[22] Filed: Oct. 12, 1993

[51] Int. Cl.[5] ..... B02C 1/06; B02C 19/12

[52] U.S. Cl. ..... 241/84; 241/94; 241/283; 241/606

[58] Field of Search ..... 241/283, 606, 100, 84, 241/94

[56] References Cited

U.S. PATENT DOCUMENTS

| | | | |
|---|---|---|---|
| 94,600 | 9/1869 | Hemenway . | |
| 204,165 | 5/1878 | Oliver . | |
| 206,148 | 7/1878 | Stuart . | |
| 259,949 | 6/1882 | Trumbull . | |
| 1,308,900 | 7/1919 | Gee . | |
| 1,792,522 | 2/1931 | Yates . | |
| 2,544,527 | 3/1951 | Crosland . | |
| 2,621,364 | 12/1952 | Stillman | 241/283 |
| 3,220,294 | 11/1965 | Bradburn, Sr. | 83/580 |
| 3,330,318 | 7/1967 | Tschantz | 241/283 |
| 3,404,593 | 10/1968 | Arcarese et al. . | |
| 3,469,750 | 9/1969 | Vanderbeck | 241/99 |
| 3,590,674 | 7/1971 | Maeda | 83/14 |
| 3,736,824 | 6/1973 | Dunnican et al. | 83/167 |
| 3,785,233 | 1/1974 | Robinson | 83/167 |
| 3,914,865 | 10/1975 | Oakes | 30/131 |
| 3,988,827 | 11/1976 | Sakamoto et al. | 30/92 |
| 4,035,911 | 7/1977 | Nethercutt et al. | 30/131 |
| 4,186,543 | 2/1980 | Lyell | 241/94 |
| 4,255,996 | 3/1981 | Choksi et al. | 83/140 |
| 4,269,364 | 5/1981 | Moriconi et al. | 241/36 |
| 4,275,628 | 6/1981 | Greenhouse | 83/167 |
| 4,404,881 | 9/1983 | Hanifl | 83/167 |
| 4,531,437 | 7/1985 | Szablak et al. | 83/165 |
| 4,565,311 | 1/1986 | Pugliese et al. | 225/94 |
| 4,614,035 | 9/1986 | Andrews | 30/124 |
| 4,729,515 | 3/1988 | Wagner | 241/99 |
| 4,786,280 | 11/1988 | Maeda | 604/110 |
| 4,809,915 | 3/1989 | Koffsky et al. | 241/36 |
| 4,969,379 | 11/1990 | Taylor et al. | 83/167 |
| 4,971,261 | 11/1990 | Solomons | 241/99 |
| 4,979,683 | 12/1990 | Busdeker | 241/36 |
| 5,035,367 | 7/1991 | Nojima | 241/37.5 |
| 5,054,696 | 10/1991 | Mennel et al. | 241/34 |
| 5,064,124 | 11/1991 | Chang | 241/33 |
| 5,076,505 | 12/1991 | Petrocy | 241/99 |
| 5,082,187 | 1/1992 | Kirchhoff et al. | 241/84 |

FOREIGN PATENT DOCUMENTS

WO8606314 11/1986 Spain .

*Primary Examiner*—Mark Rosenbaum
*Assistant Examiner*—John M. Husar
*Attorney, Agent, or Firm*—Price, Heneveld, Cooper, DeWitt & Litton

[57] ABSTRACT

The medical waste disposer has a frame and a receiving chamber connected with the frame. The receiving chamber has a discharge port and an anvil is connected with the receiving chamber adjacent the discharge port. The anvil has an anvil aperture extending through the anvil and aligned with the discharge port. A knife abuts and slides against the anvil along an axis. A knife hole extends through the knife. An assembly plate abuts the knife in sliding engagement to sandwich the knife between the anvil and the assembly plate. The assembly plate also has an opening extending through the plate. A drive is operatively connected with the knife to slide the knife. The knife slides between a first position in which the knife hole overlaps the anvil aperture and a second in which the knife hole is offset from the anvil aperture and overlaps the assembly plate opening. Each of the knife and the assembly plate may have a second hole or opening, spaced along the axis from the first hole or opening. Further, multiple knives and assembly plates may be stacked one upon the other to provide repeated, sequential cutting. The thickness of each knife may be sized progressively thinner to provide smaller cuttings and a desired mutilation of the waste being disposed.

45 Claims, 7 Drawing Sheets 20
22
24
26
28
30
32
34
36
40
42
44
46
48
52
54
60
62
64
84
102
110
112
114
116
120
130
132
134
164
166
III
III

MEDICAL WASTE DISPOSAL APPARATUS

BACKGROUND OF THE INVENTION

The invention relates to medical waste disposal and specifically to the disposal of medical waste of the type including syringes, scalpel blades, needles, and the like, known as sharps.

Medical waste may be generally considered a type of hazardous or even toxic waste and requires special waste handling procedures. The disposal of medical waste is controlled by various regulatory bodies which promulgate guidelines and rules for acceptable medical waste disposal procedures and processes. These regulations may include, among others, requirements for dousing the waste with disinfectants, for example. These regulations may also require the disposal of medical waste in facilities which are approved for hazardous waste disposal. Thus, specific and often burdensome procedures are commonly imposed, resulting in the disposal of medical waste being a costly proposition.

Many of the medical waste disposal apparatii currently available basically break the syringes, blades, or needles disposed in the apparatii so the medical implement may not be reused. While this disabling of the implement does satisfy various health, contamination, or safety considerations, the waste still remains classified as medical waste and requires special disposal procedures.

SUMMARY OF THE INVENTION

A medical waste disposer according to the present invention addresses the cost and hazard problems which are inherent to medical waste disposal and which are not resolved by the plethora of currently available disposers which merely disable subsequent use of medical instruments. More particularly, this clever invention is directed to an area of medical waste regulations which provides that disposal of medical sharps may be declassified to general waste if the sharps are mutilated in accordance with particular specifications. The invention accomplishes this task of medical waste mutilation with a new cutting blade arrangement.

A medical waste disposal apparatus according to the present invention has a frame and a receiving chamber connected with the frame. Medical waste enters the disposer at the receiving chamber. The receiving chamber has a discharge port connected with a knife assembly. The knife assembly includes an anvil positioned adjacent the discharge port, a knife which abuts and slides against the anvil, and an assembly plate which abuts the knife, so the knife is sandwiched between and slides between the anvil and the assembly plate. The anvil has an anvil aperture through which the medical waste enters the knife assembly. The knife slides along an axis and has a knife hole extending through the knife. The assembly plate also has an opening extending through the plate. A drive is connected with the knife to slide the knife along the knife axis.

In one aspect of the invention, the knife slides between a first position in which the knife hole overlaps the anvil aperture and a second position in which the knife hole is offset from the anvil aperture. In a further aspect, the knife hole overlaps the assembly plate opening when the knife is in the second position. Further yet, the knife may have a second hole spaced along the knife axis from the first knife hole and the assembly plate may have a second opening spaced from the first opening. The two knife holes are located so the second knife hole overlaps the anvil aperture when the knife is in the second position. The two assembly plate openings are arranged so the second knife hole overlaps the second assembly plate opening when the knife is in the first position.

In another aspect of the invention, the anvil may include a first plate, a second plate, and a blade with the blade being substantially similar to the knife. The blade is interposed or sandwiched in sliding engagement between the first plate and the second plate, similar to the knife relative to the anvil and the assembly plate. The blade is also connected with the drive to slide the blade between the two plates. Further, the anvil aperture has two parts defined by the first and second plates, respectively. The second part of the anvil aperture is smaller than the first part.

In yet another aspect of the invention, each knife hole has a side wall which defines a cutting edge. The side wall also defines an acute angle with one of the knife surfaces. More specifically, each knife hole may define a conic frustrom. In conjunction or alternatively, the cutting edge may also be serrated.

Thus, a medical waste disposal apparatus according to the invention provides a single or multiple stack sliding blade knife assembly to mutilate medical waste which is fed into the knife blade assembly. The mutilated waste which results from processing by the disposer of the present invention may be controlled by varying the thickness of the knife blade and the number of knife blades stacked in the knife assembly.

These and other features, objects, and benefits of the invention will be recognized by those who practice the invention and by those skilled in the art, from the specification, the claims, and the drawings.

DESCRIPTION OF THE PREFERRED EMBODIMENTS

Figure 1:
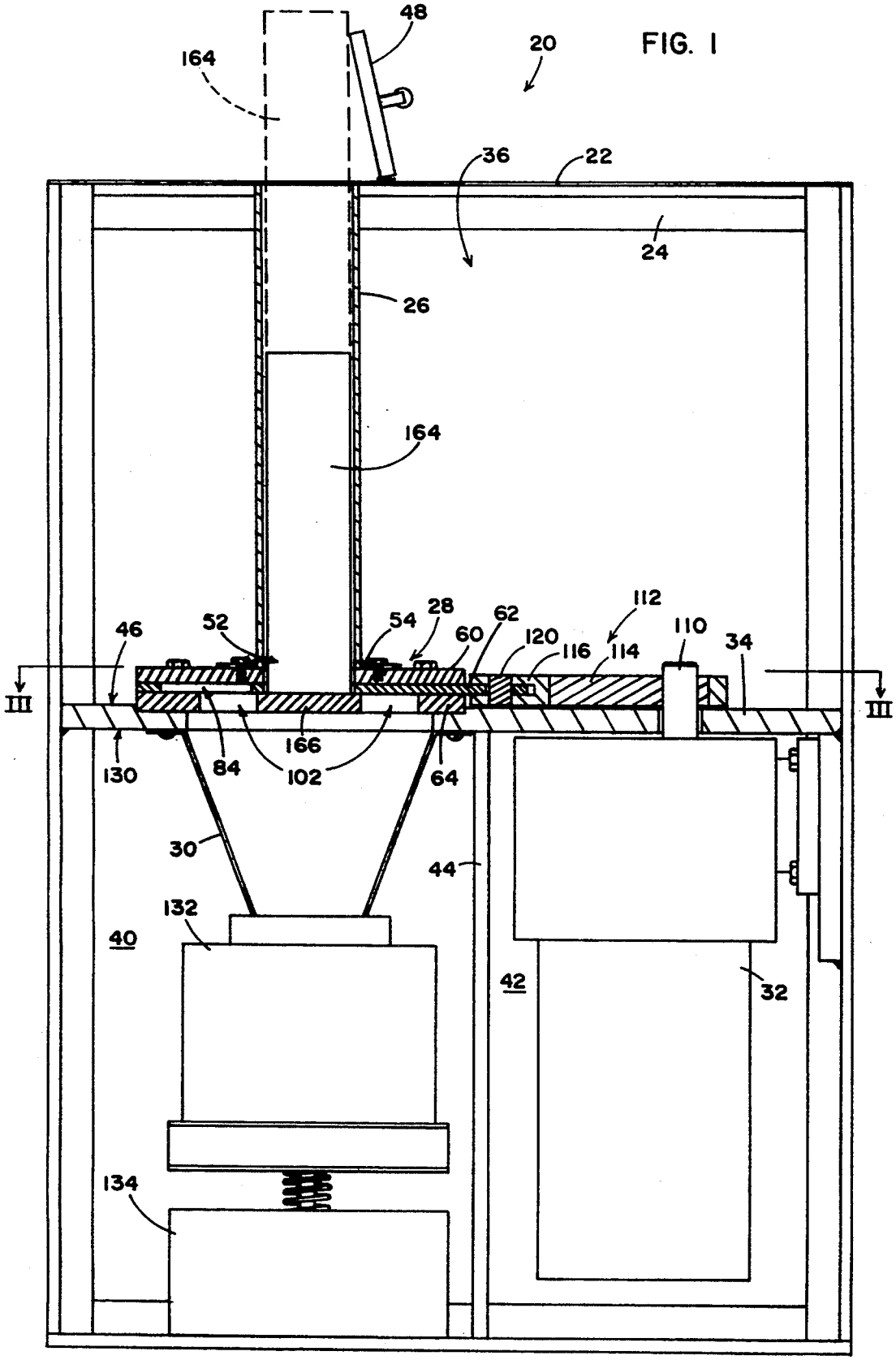
FIG. 1 is a cross-sectional view of a medical waste disposal apparatus according to the present invention.

A preferred embodiment of a medical waste disposal apparatus according to the present invention is shown in FIGS. 1–6 and generally referenced by numeral 20 (FIG. 1). Disposer 20 has a housing 22 with a frame 24 in which a receiving chamber 26, a knife assembly 28, a discharge chamber 30, and a drive motor 32 are assembled.

The frame 24 may be constructed as a perimeter framework of 1×1×1/6 inch angle iron, aluminum angle, or the like as is commonly known. Frame 24 may be sheathed with stainless steel or other suitable materials which may include, but not be limited to, plastics or other easily cleanable and durable materials, to define the housing 22 of disposer 20. However, any suitable structural framework, including a uni-frame construction or alternative materials may also be used. A mounting plate 34 is provided about midway vertically in frame 24 for mounting components of disposer 20. Mounting plate 34 is preferably about ½ to 1 inch (1.27 to 2.54 cm) thick steel plate, but may alternatively be constructed as a stiffener reinforced panel, for example. Mounting plate 34 may also be constructed of any suitable engineering material, including, but not limited to, plastics. Mounting plate 34 defines an upper chamber 36 in disposer 20 and defines two lower chambers 40 and 42 in conjunction with a vertical divider 44.

The knife assembly 28 is preferably mounted on a top surface 46 of mounting plate 34 with receiving chamber 26 extending upward through upper chamber 36, from knife assembly 28 to an access hatch 48 in the top of housing 22. The access hatch 48 is provided by a cooperating opening corresponding to receiving chamber 26 and a spring loaded door which is hinged to housing 22 and biased to a closed position. Receiving chamber 26 is defined by a tubular member having an inside diameter of roughly about two to four inches (about 5–10 cm) and a length of roughly about twelve to fifteen inches (about 30–38 cm). A discharge port 52 is provided at one end of receiving chamber 26 and coupled with knife assembly 28. The relatively long, narrow configuration of receiving chamber 26 serves a safety feature of making knife assembly 28 relatively inaccessible to a user through access hatch 48, among other benefits.

While the interconnection of receiving chamber 26 and knife assembly 28 is shown in the figures to include a mounting collar 54 bolted to knife assembly 28, various other suitable and durable couplings between receiving chamber 26 and knife assembly 28 may be used and will occur to those who practice the invention. Knife assembly 28 includes an anvil 60, a knife blade 62, and an assembly plate 64 (FIGS. 1–8). The anvil 60 is connected with receiving chamber 26 at receiving chamber discharge port 52 and has a generally planer anvil surface 66 facing away from receiving chamber 26. A cooperating anvil aperture 68, corresponding to receiving chamber discharge port 52, extends through anvil 60 and is aligned with the discharge port. Most preferably, anvil 60 is formed of a hard cutting material such as a plate of M1 steel which is commonly known or of another suitable, hardened cutting material.

Figure 3:
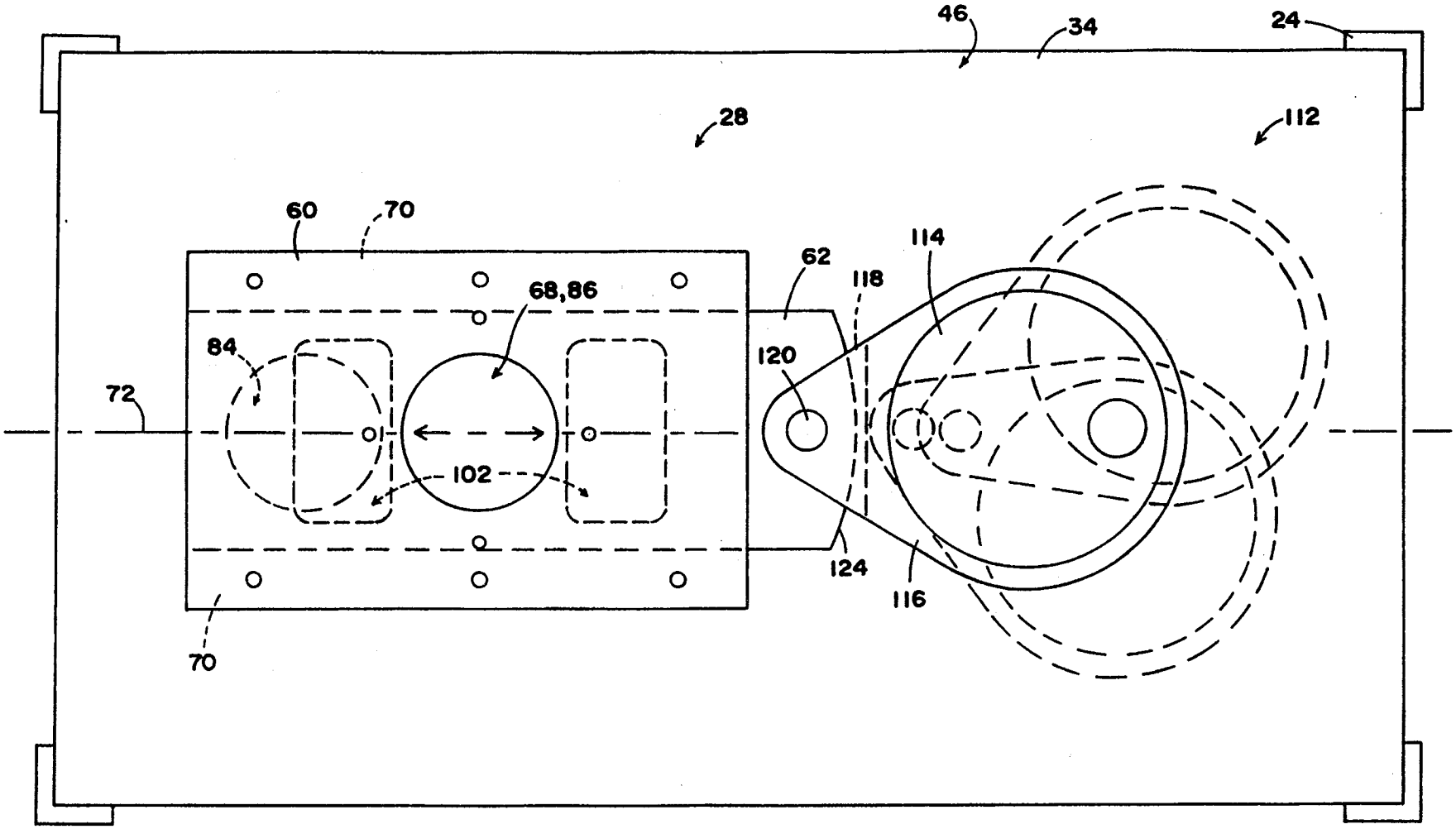
FIG. 3 is cross-sectional view of the disposer of FIG. 1 taken along the line III—III.
Figure 4:
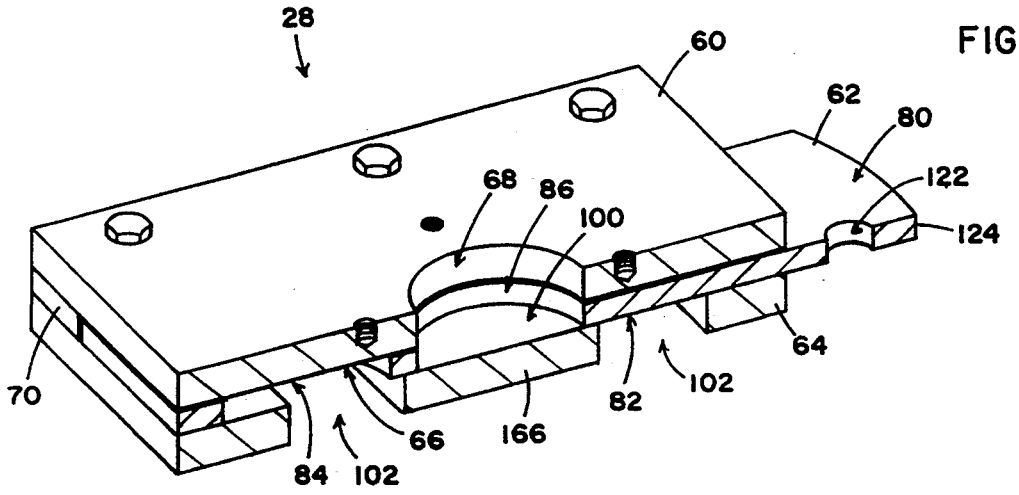
FIG. 4 is a centerline cross-sectional perspective view of the knife assembly of FIG. 2 with the knife in a first position.
Figure 5:
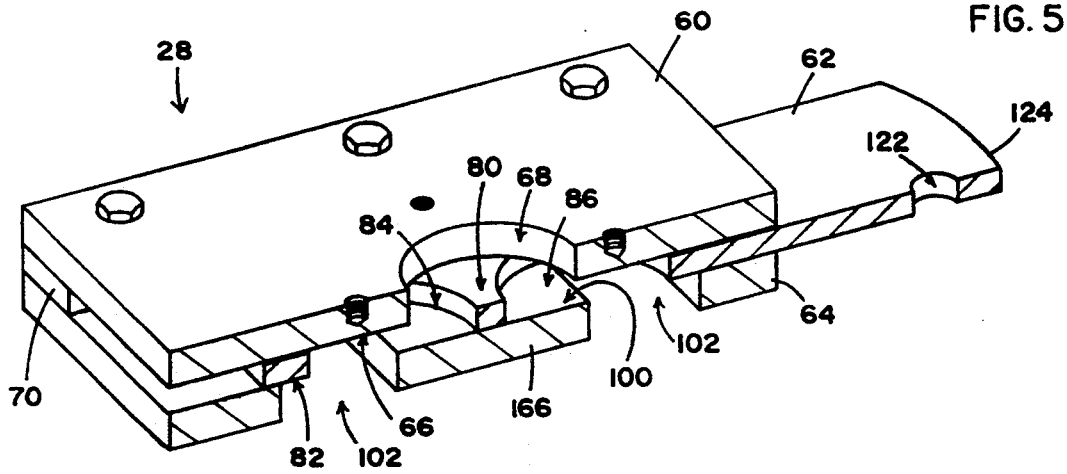
FIG. 5 is a centerline cross-sectional perspective view of the knife assembly of FIG. 2 with the knife in an intermediate position.

The knife blade 62 is sandwiched in sliding engagement between anvil 60 and assembly plate 64. Thus, spacer plates 70 are provided along each side of knife blade 62 and are sized to provide sliding clearance of knife blade 62 between anvil 60 and assembly plate 64. The spacers 70 also serve to guide knife blade 62 in sliding along an axis 72 (FIG. 3). Anvil 60, spacers 70, and assembly plate 64 may be fastened together by any suitable means available, including, but not limited to screws or bolts as is generally shown in the drawing figures, and combined with knife blade 62 to form knife assembly 28.

Figure 2:
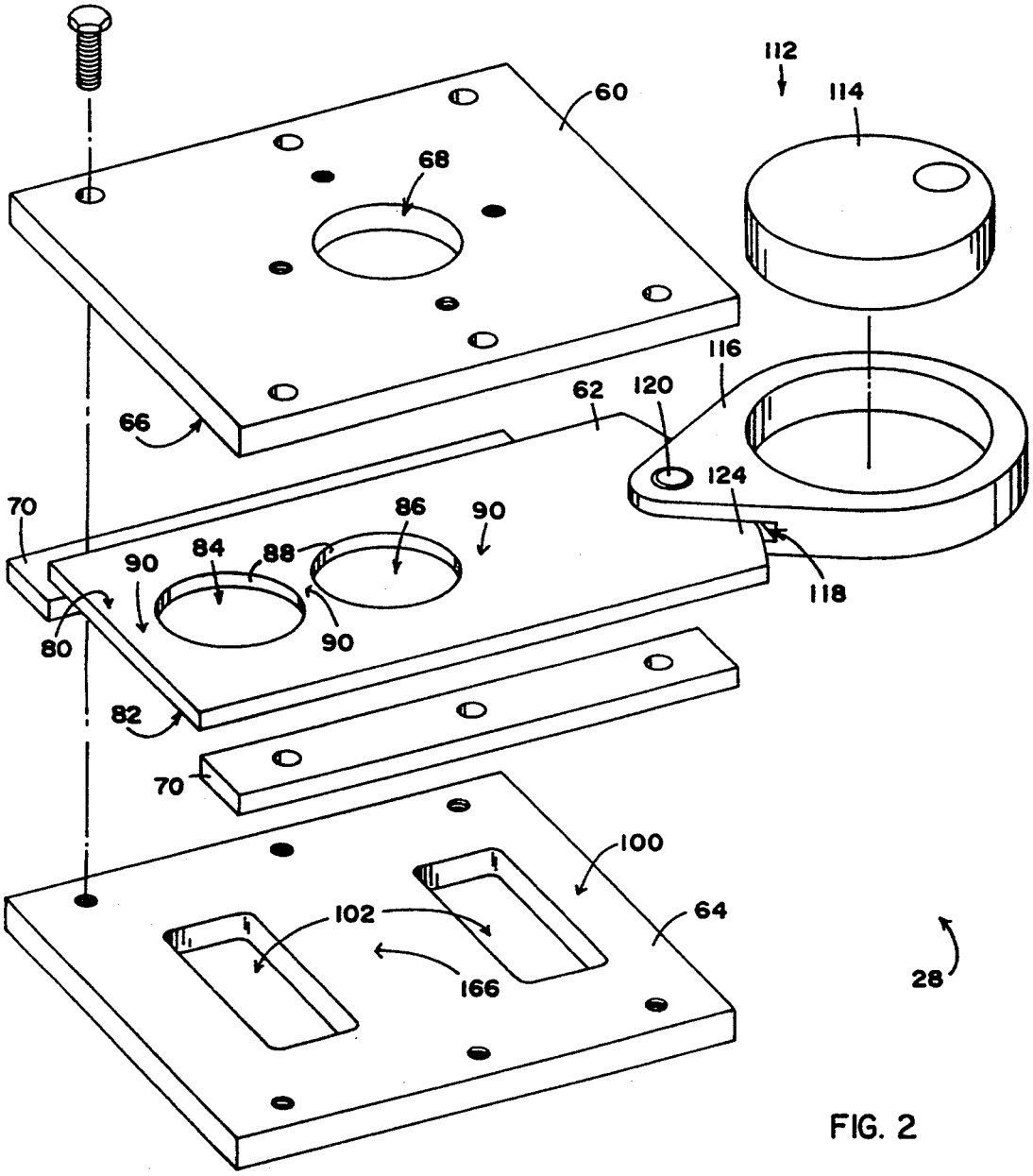
FIG. 2 is an exploded perspective view of a knife assembly of the disposer of FIG. 1.
Figure 6:
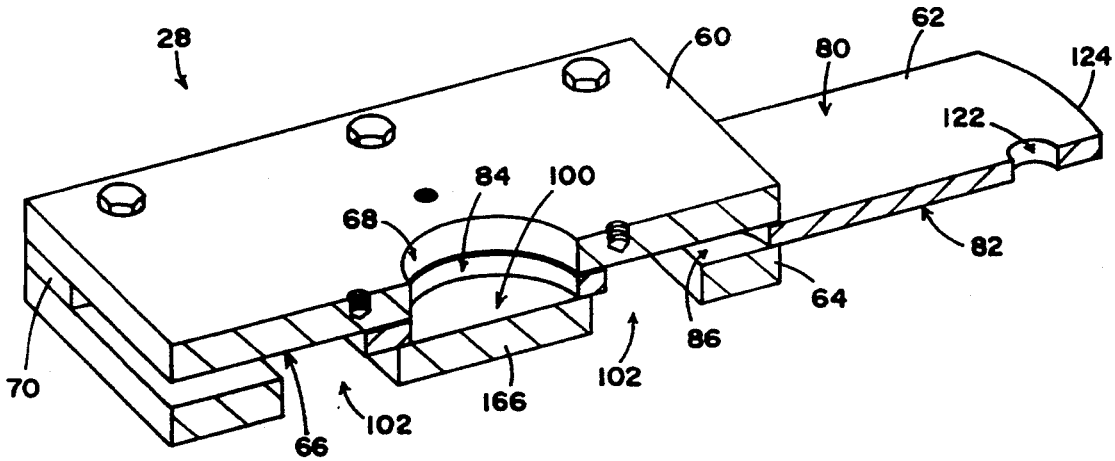
FIG. 6 is a centerline cross-sectional perspective view of the knife assembly of FIG. 2 with the knife in a second position.
Figure 7:
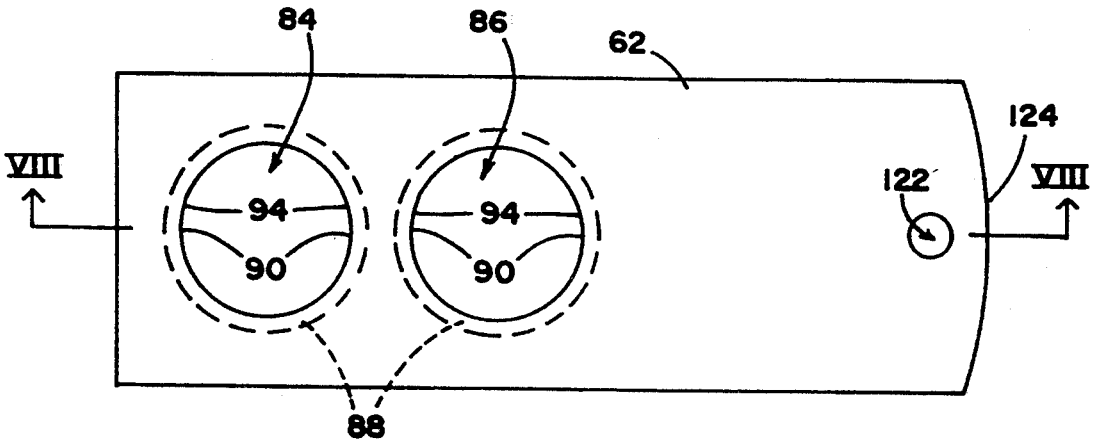
FIG. 7 is a top plan view of the knife blade, showing an alternative knife hole configuration.
Figure 8:
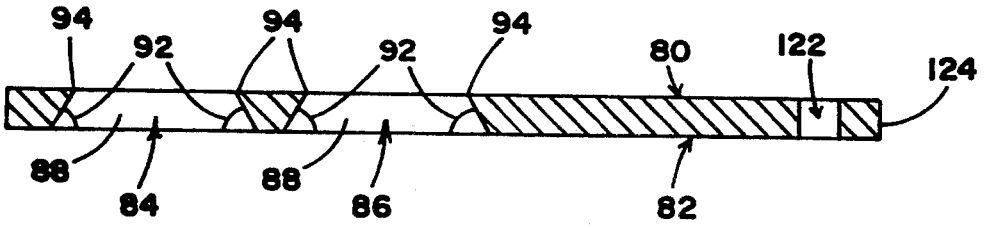
FIG. 8 is a lengthwise centerline cross-sectional view taken along line VIII—VIII.

Knife blade 62 is a plate member preferably with a thickness of about ¼ to 2 inches (0.63 to 5.08 cm), having two opposing planer surfaces, 80 and 82, and preferably having two knife holes, 84 and 86 (FIGS. 2 and 4–6). Although, the invention will also work satisfactorily with only one knife hole. Knife blade 62 is also formed of a hard cutting material such as M1 steel or another suitable, hardened cutting material. Each of the knife holes, 84 and 86, may be a cylindrical opening extending generally perpendicular between the opposing planer surfaces, 80 and 82, of knife blade 62. Alternatively, as shown in FIGS. 6 and 7, the knife holes 84, 86 may be configured with an inclined knife hole wall 88 at least at the leading and trailing areas 90 of each knife hole (i.e. diametrically opposing areas laying along axis 72) to define an acute angle 92 between knife hole wall 88 and one of the knife surfaces 80 and 82. The inclination of knife hole wall 88 will enhance a cutting edge 94 defined between knife hole wall 88 and one of the knife surfaces 80, 82 and enhance the shear cutting action of knife blade 62. For ease of production and further cutting enhancement, each knife hole 84 and 86 may be configured as a conic frustrom. Cutting edge 94 may also be serrated. As discussed above, assembly plate 64 abuts knife blade 62 to sandwich the knife blade in sliding engagement between anvil 60 and assembly plate 64 (FIG. 2). Thus, assembly plate 64 has a generally planer surface 100 abutting knife blade 62. Assembly plate 64 also has a pair of openings 102 extending through the assembly plate. The assembly plate openings 102 are spaced from each other, along axis 72. Assembly plate 64 is preferably a ½ inch (1.27 cm) thick steel plate, but may also be constructed as a thinner panel with stiffeners. Further, assembly plate 64 may be constructed of any suitable engineering material, including plastics for example.

Drive motor 32 is preferably an about fifteen amp, electric motor, running at about ninety revolutions per minute on household current, and mounted under mounting plate 34 to provide a low, stabilizing center of gravity (FIG. 1). A shaft 110 of drive motor 32 extends through mounting plate 34 and is connected with knife assembly 28, more particularly knife blade 62, by an eccentric circular cam assembly 112 (FIGS. 1–3). Cam assembly 112 includes a circular cam 114 having a diameter of about 3 inches (7.62 cm) and a thickness of about ½ inch (1.27 cm), eccentrically mounted about 1 ½ inch (3.81 cm) off center on motor shaft 110, and includes a cooperating crank 116 slip fit around the cam. Crank 116 is formed with a notch 118 to receive an end 124 of knife blade 62 and pivotally connect with end 124 by a pivot pin 120 extending through the crank and a pin hole 122 in the knife blade. To minimize wear and enhance durability, an annular brass bushing or the like may be interposed between circular cam 114 and crank 116.

Discharge chamber 30 is a funnel member mounted to an undersurface 130 of mounting plate 34 and located to overlay the openings 102 in assembly plate 64. Discharge chamber 30 may be formed of any suitably durable and easily cleanable material, such as stainless steel and various plastics for example. A removable collection container 132 is positioned below discharge chamber 30 to collect processed waste. Preferably, collection container 132 is fabricated from a recyclable material and is supported on a weight sensitive stand 134. Most preferably, stand 134 incorporates electrical circuitry connected with a control circuit for drive motor 32 to stop operation of disposer 20 when a predetermined weight of processed waste, indicating a full collection container, is collected in collection container 132. Stand 134 may also incorporate circuitry to preclude operation of disposer 20 if collection container 132 is not in position on stand 134.

An access door (not shown) is provided in housing 22 to access and remove collection container 132 from disposer 20. The control circuit for drive motor 32 is preferable provided with a control switch connected with the access door to stop operation of disposer 20 when the access door is not in a closed condition. The control circuit for drive motor 32 may also be provided with a timer circuit so a user may simply deposit sharps in receiving chamber 26 and start disposer 20 to process the sharps without having to stay and attend disposer 20 or later return to turn off the disposer after complete processing of the deposited medical waste. A control circuit for disposer 20 may also include an arrangement requiring simultaneous manipulation by both hands of a user to start disposer 20 with access hatch 48 open for example. These and other operational and safety features of disposer 20, including but not limited to a control circuit switch connected with access hatch 48, for example, will occur to those who practice the invention.

In an alternative embodiment 140 (FIGS. 9 and 10) of knife assembly 28, anvil 60 includes a first anvil plate 142, a second anvil plate 144 and a second knife blade 146 interposed or sandwiched in sliding engagement between the two anvil plates 142, 144. Thus, a second pair of spacer plates, similar to spacer plates 70 discussed above, are provided to space anvil plates 142 and 144 and to guide second knife blade 146. First anvil plate 142 defines a first portion 148 of anvil aperture 68. Second anvil plate 144 defines anvil surface 66 and a second portion 150 of anvil aperture 68. The second portion 150 of anvil aperture 68 is sized smaller than the first portion 148.

The second knife blade 146 is substantially similar, if not identical, to knife blade 62 as discussed in greater detail above. However, in alternative embodiment 140, each of knife blade 62 and second knife blade 146 will most preferably have differing thicknesses with knife blade 62 being thicker than second knife blade 146 to provide progressive slicing. The second knife blade 146 may have cylindrical knife holes extending generally perpendicularly through the knife blade. Alternatively, as discussed regarding knife blade 62, the knife holes of second knife blade 146 may also be configured with an inclined knife hole wall, as a conic frustrom, or with a serrated cutting edge.

Figure 10:
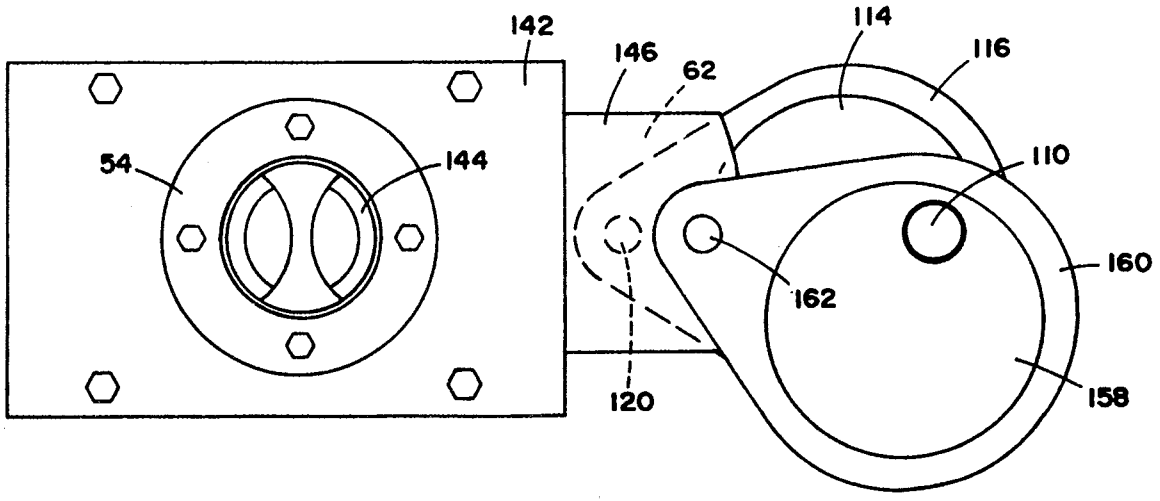
FIG. 10 is a top plan view of the knife assembly of FIG. 9.

Similar to cam assembly 112 relative to knife assembly 28, a second cam assembly 156 interconnects second knife blade 146 with motor shaft 110. Cam assembly 156 includes a circular cam 158 eccentrically mounted on motor shaft 110. A crank 160 circumscribes cam 158 in slip-fit engagement and is pivotally coupled with knife blade 146 by a pivot pin 162. Second cam assembly 156 is similar, if not identical, to cam assembly 112 with circular cam 158 and crank 160 being configured the same as circular cam 114 and crank 116, respectively. However, as shown in FIG. 10, the eccentric mounting of cam 158 does not align cam 158 with cam 114. Rather, cam 158 is rotationally offset from cam 114. The rotational offset between cams 114 and 158 may range from about 0° to 360° . The invention has been found to perform satisfactorily with an offset of about 120° between the cams 114, 158.

In use of disposer 20 with knife assembly 28, sharps, including syringes, scalpel blades, needles, and the like, are preferably collected in a sharps container 164 immediately after use. The sharps container 164 is preferably a cylindrical vessel having an outside diameter sized for slip fit through receiving chamber 26 (FIG. 1). The length of sharps container 164 is most preferably no more than about sixty to eighty percent of the length of receiving chamber 26 so at least two sharps containers 164 may be stacked to automatically feed into receiving chamber 26. The sharps container 164 may be fabricated of various materials, including plastics and metals and the like, but is most preferably a recyclable material which may be processed and recycled with the sharps. With the benefit of the teachings presented here, further arrangements for feeding sharps into disposer 20 will, of course, occur to those who practice the invention and to those skilled in the art.

When sharps container 164 is filled or periodically, in accordance with a medical waste disposal procedure, sharps container 164 may be deposited into disposer 20 by opening hatch 46 and inserting the sharps container into receiving chamber 26. Since sharps container 164 is less than the full length of receiving chamber 26, a second sharps container (shown in phantom in FIG. 1) may be stacked upon the first sharps container in receiving chamber 26.

After the sharps are loaded into receiving chamber 26, disposer 20 may be started by activating the control circuit, discussed above. Cam 114 will turn with motor shaft 110. By the eccentric mounting of cam 114 and through the interconnection of cam 114 with knife blade 62 by crank 116, the knife blade will stroke or oscillate, preferably a length of about two and a quarter inches (5.8 cm), from a first position (FIG. 4), through an intermediate position (FIG. 5), to a second position (FIG. 6), back through the intermediate position (FIG. 5,) to the first position (FIG. 4), and so on. While knife blade 62 strokes, the sharps container 164 and sharps are gravity fed into one or the other of knife holes 84 and 86 in alternating succession (FIG. 1). The sharps container 164 and sharps do not freely fall through knife assembly 28, but land on and are supported by a portion 166 of assembly plate 64, which is aligned with anvil aperture 68 (FIGS. 1, 2, and 4–6). Thus, each slice cut by knife blade 62 is metered to the thickness of the knife blade and the thickness of each slice may be regulated by adjusting the thickness of knife blade 62 and spacers 70.

As knife blade 62 continues to cycle, successive slices or layers of the sharps container 164 and sharps are sheared off and mutilated by knife blade 62 sliding against anvil 60. With continued oscillating of knife blade 62, each successive slice of the medical waste is sheared, mutilated, and transferred to fall through one or the other of assembly plate openings 102 and into discharge chamber 30 (FIG. 1). The processed waste is funnelled through discharge chamber 30 into collection container 132.

When collection container 132 fills with processed waste, the weight bearing on stand 134 increases to a predetermined amount which indicates that collection container 132 is full and which actuates the control circuit for disposer 20 to stop further processing, as discussed above. Alternatively, if the sharps deposited in disposer 20 are not sufficient to fill collection container 132, a timer for the control circuit may stop processing by disposer 20 after a predetermined time, also as discussed above.

Figure 9:
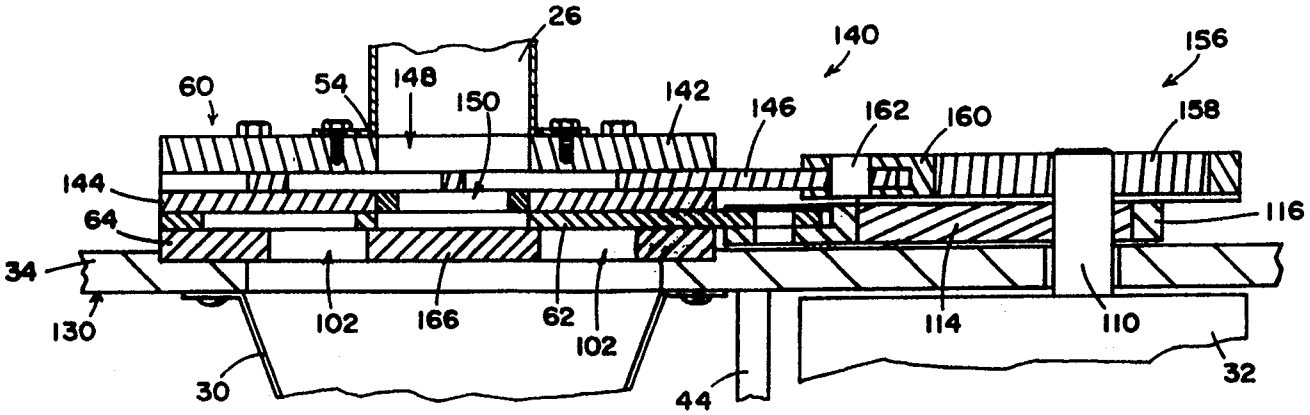
FIG. 9 is a fragmentary cross-sectional view showing an alternative embodiment of the knife assembly.

Operation of disposer 20 with the alternative embodiment 140 of the knife assembly is substantially as just described. However, alternative embodiment 140 of the knife assembly adds another layer of knife cutting activity in which the sharps container 164 and sharps are gravity fed into one or the other of the knife holes of knife blade 146 (FIGS. 9 and 10). The sharps and container 164 do not fall freely through knife blade 146, but are supported by the smaller size of the second portion 150 of anvil aperture 68 to meter the thickness of each slice cut by second knife blade 146.

Figure 11:
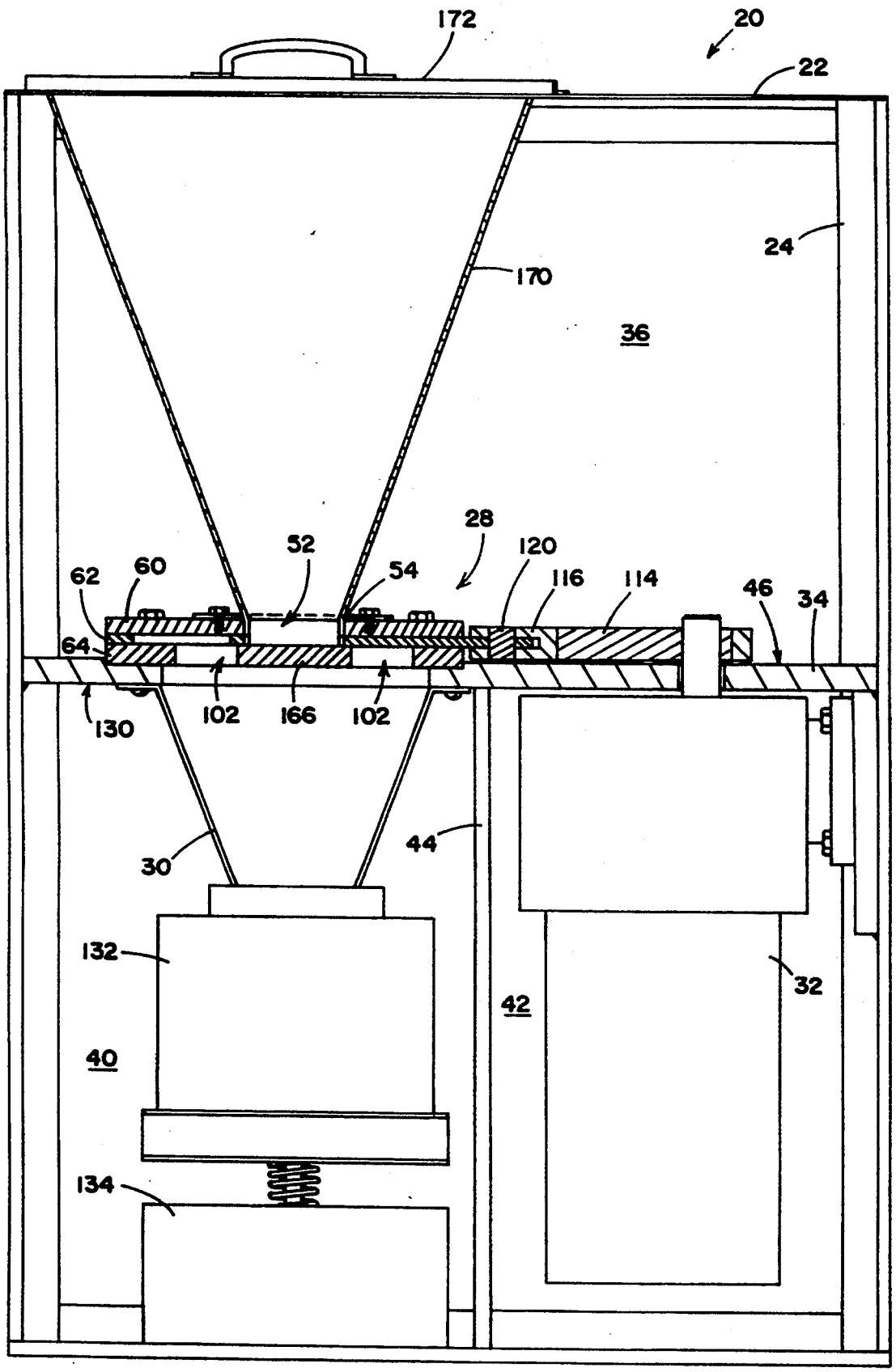
FIG. 11 is a centerline cross-sectional view of an alternative embodiment of a medical waste disposal apparatus according to the present invention.

In an alternative embodiment 170 of receiving chamber 26, the receiving chamber is defined by a funnel member (FIG. 11). Receiving chamber 170 extends upward through upper chamber 36, from either knife assembly 28 or 120, to an enlarged access hatch 172 in the top of housing 22. In this configuration, user access to either knife assembly 28 or 120, is easier. Thus, the control circuit for disposer 20 using the funnel receiving chamber 170 most preferably precludes starting or running the disposer at any time enlarged access hatch 172 is open. The funnel receiving chamber 170 does, however, accommodate reuse of the sharps container 164 by simply dumping the sharps from the sharps container into the receiving chamber.

Thus, a medical waste disposal apparatus according to this invention provides an attractive and cost saving answer to the medical waste disposal problem by processing the medical waste or sharps into a mutilated material which may be recycled or disposed of according to declassified general waste, rather under the burdensome disposal requirements of the medical waste classification.

It will be understood by those who practice the invention and by those skilled in the art, that various modifications and improvements may be made to the invention without departing from the spirit of the disclosed concept. An added feature of disinfectant dousing of the processed waste may, for example, be added to the invention. A collection container tumbler may also be added to disposer 20 to tumble the collection container and assure complete dousing of the processed waste with a disinfectant. Further, while the drawing figures show the receiving chamber and knife assembly oriented generally perpendicular to one another, their respective orientation may also be angled. Thus, the scope of protection afforded is to be determined by the claims and by the breadth of interpretation allowed by law.

The embodiments of the invention in which an exclusive property or privilege is claimed are defined as follows:

1. A medical waste disposal apparatus comprising:

a frame;

a receiving chamber connected with said frame, said receiving chamber having a discharge port;

an anvil connected with said receiving chamber and positioned adjacent said discharge port, said anvil having a generally planar anvil surface on a side of said anvil positioned away from said receiving chamber, said anvil having a cooperating anvil aperture extending through said anvil and aligned with said discharge port;

a knife having two opposing, generally planar knife surfaces and positioned with a first knife surface of said two opposing knife surfaces abutting said anvil surface in sliding engagement, said knife sliding along an axis, said knife having a knife hole extending through said knife;

an assembly plate having a generally planar surface abutting a second knife surface of said two opposing knife surfaces in sliding engagement to sandwich said knife between said anvil and said assembly plate, said assembly plate having an opening extending through said assembly plate; and a drive operatively connected with said knife to slide said knife.

2. The apparatus defined in claim 1 wherein said knife slides between a first position in which said knife hole overlaps said anvil aperture and a second position in which said knife hole is offset from said anvil aperture.

3. The apparatus defined in claim 2 wherein said knife hole overlaps said member opening when said knife is in said second position.

4. The apparatus defined in claim 3 wherein said knife has a second knife hole, said second knife hole being spaced along said axis from said knife hole, said second knife hole overlapping said anvil aperture when said knife is in said second position and wherein said assembly plate has a second opening, said second opening being spaced from said opening of said assembly plate, said second knife hole overlapping said second member opening when said knife is in said first position.

5. The apparatus defined in claim 4 wherein said anvil further includes a first plate, a second plate, and a blade, said blade being substantially similar to said knife and being interposed in sliding engagement between said first plate and said second plate.

6. The apparatus defined in claim 5 wherein said blade is operatively connected with said drive to slide said blade.

7. The apparatus defined in claim, 6 wherein said anvil aperture has a first part defined by said first plate and has a second part defined by said second plate, said second part being smaller than said first part.

8. The apparatus defined in claim 7 wherein each said knife hole has a sidewall defining a cutting edge between said sidewall and one of said two opposing knife surfaces and wherein said sidewall defines an acute angle with said one of said two opposing knife surfaces.

9. The apparatus defined in claim 8 wherein each said knife hole defines a conic frustrom.

10. The apparatus defined in claim 8 wherein each said cutting edge is serrated.

11. The apparatus defined in claim 1 wherein said anvil further includes a first plate, a second plate, and a blade; said blade being substantially similar to said knife and being interposed in sliding engagement between said first plate and said second plate.

12. The apparatus defined in claim 11 wherein said blade is operatively connected with said drive to slide said blade.

13. The apparatus defined in claim 12 wherein said anvil aperture has a first part defined by said first plate and has a second part defined by said second plate, said second part being smaller than said first part.

14. The apparatus defined in claim 13 wherein said knife hole has a sidewall defining a cutting edge between said sidewall and one of said two opposing knife surfaces and wherein said sidewall defines an acute angle with said one of said two opposing knife surfaces.

15. The apparatus defined in claim 14 wherein said knife hole defines a conic frustrom.

16. The apparatus defined in claim 13 wherein said knife hole and one of said two opposing knife surfaces define a cutting edge and said cutting edge is serrated.

17. The apparatus defined in claim 1 wherein each said knife hole has a sidewall defining a cutting edge between said sidewall and one of said two opposing knife surfaces and wherein said sidewall defines an acute angle with said one of said two opposing knife surfaces.

18. The apparatus defined in claim 17 wherein said knife hole defines a conic frustrom.

19. The apparatus defined in claim 1 wherein said knife hole defines a conic frustrom.

20. A medical waste disposal apparatus comprising:

a frame;

a receiving chamber connected with said frame, said receiving chamber having an access port and a discharge port, said discharge port including an anvil circumscribing said discharge port, said anvil having a generally planar anvil surface on a side of said anvil positioned away from said receiving chamber;

a knife having two opposing, generally planar knife surfaces and positioned with a first knife surface of said two opposing knife surfaces abutting said anvil surface in sliding engagement, said knife sliding along an axis, said knife having a first hole and a second hole, each of said first hole and said second hole extending through said knife, said first hole and said second hole being spaced from one another along said axis; and a member having a generally planar member surface abutting a second knife surface of said two opposing knife surfaces in sliding engagement to sandwich said knife between said anvil and said member, said member having an opening extending through said member; and a drive operatively connected with said knife to slide said knife.

21. The apparatus defined in claim 20 wherein said knife slides between a first position in which said first hole overlaps said discharge port and a second position in which said second hole overlaps said discharge port.

22. The apparatus defined in claim 21 wherein said member has a second opening, said second opening being spaced from said opening of said member, said second hole of said knife overlapping said second opening when said knife is in said first position, said first hole of said knife overlapping said opening of said member when said knife is in said second position.

23. The apparatus defined in claim 22 wherein said anvil further includes a first plate, a second plate, and a blade, said blade being substantially similar to said knife and being interposed in sliding engagement between said first plate and said second plate.

24. The apparatus defined in claim 23 wherein said blade is operatively connected with said drive to slide said blade.

25. The apparatus defined in claim 24 wherein said anvil aperture has a first part defined by said first plate and has a second part defined by said second plate, said second part being smaller than said first part.

26. The apparatus defined in claim 25 wherein each said knife hole has a sidewall defining a cutting edge between said sidewall and one of said two opposing knife surfaces and wherein said sidewall defines an acute angle with said one of said two opposing knife surfaces.

27. The apparatus defined in claim 26 wherein each said knife hole defines a conic frustrom.

28. The apparatus defined in claim 27 wherein each said cutting edge is serrated.

29. The apparatus defined in claim 20 wherein said anvil further includes a first plate, a second plate, and a blade, said blade being substantially similar to said knife and being interposed in sliding engagement between said first plate and said second plate.

30. The apparatus defined in claim 29 wherein said anvil aperture has a first part defined by said first plate and has a second part defined by said second plate, said second part being smaller than said first part.

31. The apparatus defined in claim 30 wherein each said knife hole has a sidewall defining a cutting edge between said sidewall and one of said two opposing knife surfaces and wherein said sidewall defines an acute angle with said one of said two opposing knife surfaces.

32. The apparatus defined in claim 31 wherein each said cutting edge is serrated.

33. The apparatus defined in claim 20 wherein each said knife hole has a sidewall defining a cutting edge between said sidewall and one of said two opposing knife surfaces and wherein said sidewall defines an acute angle with said one of said two opposing knife surfaces.

34. A medical waste disposal apparatus comprising:

a frame;

a receiving chamber connected with said frame, said receiving chamber having an access port and a discharge port;

an anvil connected with said discharge port, said anvil including a generally planar anvil surface on a side of said anvil positioned away from said receiving chamber and including an anvil aperture corresponding to said discharge port, said anvil aperture extending through said anvil and being aligned with said discharge port;

a knife having two opposing, generally planar knife surfaces, said knife being positioned with a first knife surface of said two opposing knife surfaces abutting said anvil surface in sliding engagement, said knife sliding along an axis, said knife having at least one knife hole extending through said knife;

an assembly plate having a generally planar plate surface abutting a second knife surface of said two opposing knife surfaces in sliding engagement to sandwich said knife between said anvil and said assembly plate, said assembly plate having a plate opening extending through said assembly plate;

a first spacer interposed between said anvil and said assembly plate, said first spacer abutting a first of two opposing edges of said knife;

a second spacer interposed between said anvil and said assembly plate, said second spacer abutting a second of said two opposing edges of said knife; and a drive operatively connected with said knife to slide said knife.

35. The apparatus defined in claim 34 wherein said knife slides between a first position in which said knife hole overlaps said anvil aperture and a second position in which said knife hole is offset from said anvil aperture, and wherein said knife hole overlaps said plate opening when said knife is in said second position.

36. The apparatus defined in claim 35 wherein said anvil further includes a first plate, a second plate, and a blade, said blade being substantially similar to said knife and being interposed in sliding engagement between said first plate and said second plate.

37. The apparatus defined in claim 36 wherein said blade is operatively connected with said drive to slide said blade.

38. The apparatus defined in claim 37 wherein said anvil aperture has a first part defined by said first plate and has a second part defined by said second plate, said second part being smaller than said first part.

39. The apparatus defined in claim 38 wherein each said knife hole has a sidewall defining a cutting edge between said sidewall and one of said two opposing knife surfaces and wherein said sidewall defines an acute angle with said one of said two opposing knife surfaces.

40. The apparatus defined in claim 39 wherein each said knife hole defines a conic frustrom.

41. The apparatus defined in claim 40 wherein each said cutting edge is serrated.

42. The apparatus defined in claim 34 wherein said anvil further includes a first plate, a second plate, and a blade, said blade being substantially similar to said knife and being interposed in sliding engagement between said first plate and said second plate, said blade being operatively connected with said drive to slide said blade.

43. The apparatus defined in claim 42 wherein each said knife hole has a sidewall defining a cutting edge between said sidewall and one of said two opposing knife surfaces and wherein said sidewall defines an acute angle with said one of said two opposing knife surfaces.

44. The apparatus defined in claim 43 wherein each said knife hole defines a conic frustrom.

45. The apparatus defined in claim 44 wherein each said cutting edge is serrated.

* * * * *